US007582822B1

(12) United States Patent
Olander-Waters et al.

(10) Patent No.: US 7,582,822 B1
(45) Date of Patent: Sep. 1, 2009

(54) METRONOME AND SYSTEM FOR MAINTAINING A COMMON TEMPO AMONG A PLURALITY OF MUSICIANS

(76) Inventors: Stephen Olander-Waters, 8207 Wexford Dr., Austin, TX (US) 78759-4442; Andrew Heiveil, 13271 Kerrville Folkway, Austin, TX (US) 78729-7842

( * ) Notice: Subject to any disclaimer, the term of this patent is extended or adjusted under 35 U.S.C. 154(b) by 0 days.

(21) Appl. No.: 11/752,552

(22) Filed: May 23, 2007

Related U.S. Application Data

(60) Provisional application No. 60/803,236, filed on May 25, 2006.

(51) Int. Cl.
*G04F 5/04* (2006.01)

(52) U.S. Cl. ..... 84/484; 84/611; 84/723; 84/730

(58) Field of Classification Search ..... 84/484, 84/611, 723, 730
See application file for complete search history.

(56) References Cited

U.S. PATENT DOCUMENTS 3,263,551 A * 8/1966 Musser ..... 84/484
4,437,381 A * 3/1984 Chen ..... 84/484
4,805,203 A * 2/1989 Oda ..... 455/462
4,868,549 A * 9/1989 Affinito et al. ..... 345/164
5,689,077 A * 11/1997 Jasinski ..... 84/477 R
5,959,230 A * 9/1999 Fulford ..... 84/464 R
6,084,168 A * 7/2000 Sitrick ..... 84/477 R
D449,236 S * 10/2001 Hopkins ..... D10/43
6,353,429 B1 * 3/2002 Long ..... 345/158
D488,078 S * 4/2004 Nakajima et al. ..... D10/43
6,727,419 B1 * 4/2004 Diaz ..... 84/484
6,859,530 B1 * 2/2005 Terada et al. ..... 379/374.01
6,969,795 B2 * 11/2005 Hofmeister et al. ..... 84/600
7,030,308 B2 * 4/2006 Yagi ..... 84/484
7,081,577 B2 * 7/2006 Nagakura ..... 84/484
7,122,004 B1 * 10/2006 Cassily ..... 600/300
7,268,290 B2 * 9/2007 Parsons et al. ..... 84/723
7,285,101 B2 * 10/2007 Tumey ..... 601/46
7,294,777 B2 * 11/2007 Hofmeister et al. ..... 84/615
7,304,230 B2 * 12/2007 Parsons et al. ..... 84/611
7,368,651 B2 * 5/2008 Duke ..... 84/464 R
7,390,955 B2 * 6/2008 Parsons et al. ..... 84/611
2002/0149561 A1 * 10/2002 Fukumoto et al. ..... 345/156
2003/0024375 A1 * 2/2003 Sitrick ..... 84/477 R
2004/0067780 A1 * 4/2004 Eiden ..... 455/567
2004/0099132 A1 * 5/2004 Parsons ..... 84/730
2004/0100366 A1 * 5/2004 Parsons ..... 340/407.1
2004/0206226 A1 * 10/2004 Negoescu et al. ..... 84/600
2004/0255756 A1 * 12/2004 Nagakura ..... 84/484
2006/0070514 A1 * 4/2006 Parsons et al. ..... 84/730
2006/0150803 A1 * 7/2006 Taub ..... 84/616

(Continued)

*Primary Examiner*—Jeffrey Donels
*Assistant Examiner*—Robert W Horn
(74) *Attorney, Agent, or Firm*—Johnson & Associates

(57) ABSTRACT

A method and apparatus provides metronomes capable of wireless synchronization with other similar metronomes. A metronome includes a tactile device capable of conveying the tempo and beat to a user without the use of sound. In one example, one of the metronomes is used as a lead unit (for example, controlled by a band leader or conductor) and transmits control signals to the other metronomes. This allows multiple musicians in an orchestra, or similar music ensemble, to each have a metronome that is synchronized with other metronomes and shares a common tempo and beat.

22 Claims, 10 Drawing Sheets

U.S. PATENT DOCUMENTS

2006/0162532 A1* 7/2006 Eidson et al. ..... 84/600
2007/0089591 A1* 4/2007 Boys ..... 84/609
2007/0119294 A1* 5/2007 Parsons et al. ..... 84/730
2007/0137463 A1* 6/2007 Lumsden ..... 84/603
2008/0025536 A1* 1/2008 Chalupper et al. ..... 381/312

* cited by examiner

METRONOME AND SYSTEM FOR MAINTAINING A COMMON TEMPO AMONG A PLURALITY OF MUSICIANS

CROSS REFERENCE TO RELATED APPLICATIONS

This application claims priority under 35 U.S.C. § 119/120 to co-pending, commonly owned U.S. provisional patent application Ser. No. 60/803,236 filed on May 25, 2006, entitled "METRONOME AND SYSTEM FOR MAINTAINING A COMMON TEMPO AMONG A PLURALITY OF MUSICIANS", which is incorporated by reference herein.

FIELD OF THE INVENTION

This invention relates to metronomes. In particular, this invention is drawn to a system and method for maintaining a common beat and tempo among a plurality of musicians.

BACKGROUND OF THE INVENTION

Metronomes are typically used to produce a regulated pulse, usually used to keep a steady beat in musical performances. Musicians typically use metronomes when they practice, in order to keep a standard tempo; i.e., to keep a steady beat throughout the music.

Most modern metronomes are electronic. A typical electronic metronome has a dial or button to control the tempo. Some metronomes can produce two or more distinct sounds. A regular "tick" sound indicates the beat within each measure, and another, distinct sound (e.g., having a higher pitch and/or greater volume) indicates the beginning of each measure. A tempo control adjusts the amount of time separating each beat (typically measured in beats per minute), while another control adjusts the number of beats in each measure.

In an orchestra, or other type of musical ensemble, tempo is typically controlled by a conductor. Conducting is the act of directing a musical performance by way of visible gestures. Use of conventional metronomes in a musical ensemble is not practical since each musician must follow the beat and tempo of the conductor. If multiple musicians each used their own metronome, the metronomes would not be synchronized with each other or with the conductor. Even if the metronomes were synchronized or were set for the same tempo, they would become unsynchronized when the conductor made a change in tempo.

There are disadvantages to relying solely on directions from a conductor. For example, since visible gestures are used, a musician must use eye contact with the conductor, while also reading sheet music. This is even a greater problem where musicians can not maintain eye contact at all times, such as with a marching band.

There is a major disadvantage to sharing a single metronome: in a large auditorium or on a football field, the finite speed of sound causes each musician to hear the single metronome at a tangibly different time.

SUMMARY OF THE INVENTION

A method of providing tempo information to one or more musicians includes providing each musician with a metronome, the metronome having a receiver for receiving wireless signals from a lead device relating to a desired tempo, and having a tactile device for conveying a tactile message to a user of the metronome, enabling the receiver when a signal is expected from the lead device, disabling the receiver during times when a signal is not expected from the lead device, and providing tactile messages to the user of the metronome, wherein the tactile messages convey the desired tempo to the user.

In another example, a method of providing tempo information to one or more musicians includes providing each musician with a metronome, the metronome having a receiver for receiving wireless signals and having a tactile device for conveying a tactile message to a user of the metronome, during a first time period, enabling the receiver and receiving a signal having information relating to a desired tempo, providing tactile messages to the user of the metronome, wherein the tactile messages convey the desired tempo to the user and during a second time period, continuing to provide the tactile messages to the user while disabling the receiver.

In another example, a metronome includes a transceiver for transmitting and receiving wireless signals, a tactile device and configured to provide a tactile sensation to a user of the metronome, and a processor electrically coupled to the transceiver and the tactile device, wherein the processor causes the tactile device to convey tempo information to a user in response to a desired tempo indicated by one or more messages received by the transceiver.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
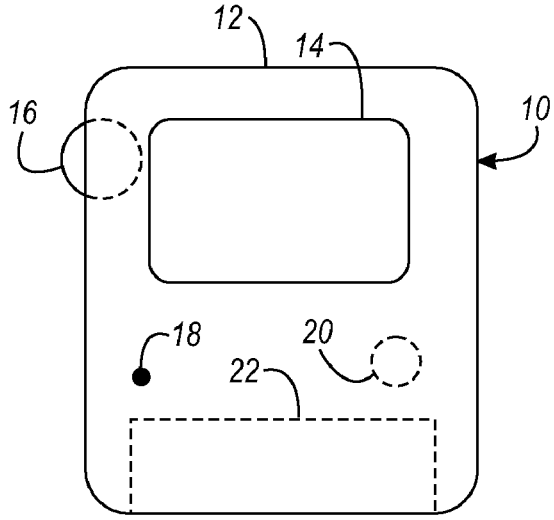
FIG. 1 illustrates a view of one example of a metronome of the present invention.

For the reader's convenience, following are some definitions of various musical terms used in the Specification:

Measure: the sequence of notes in a musical piece are divided into measures, similar to speech being divided into words, except with much greater regularity than speech.

Beat: notes are generally played at a steady pace (modern jazz is an exception). The beat is the most common duration of note in the piece of music. "Beat" is also associated with tapping your foot in time to the music. A "beat" is the entire time from when your foot taps down until the foot taps down again.

Downbeat: the first beat of each measure is the downbeat. A person tapping their foot while listening to a piece of music will contact the floor on the downbeat.

Rhythm: (also known as the "time signature") beats per measure, examples of common music notation for rhythm are 4/4, 2/4, 3/4, 6/8 respectively one downbeat per 4 beats, 1 per 2 beats, 1 per 3 beats, 1 per 6 beats. With respect to the invention, the ratio is what matters to a metronome, the traditional values indirectly represent a tempo as well as the rhythm.

Tempo: number of beats per minute (bpm). 40 bpm is suitable for funeral dirges, 200 or more for college football team anthems. With respect to the invention, while the human interface manipulates tempo as beats per minute the implementation converts that into clocks per beat.

Also for the reader's convenience, following are definitions of other terminology used in the description:

Leader (i.e., "lead unit"): the unit which is selecting the rhythm and tempo and provides the reference downbeat and beat period (implicitly defines what a second is for the assemblage of units).

Followers (i.e., "receiving units"): units which generate ticks for each user.

Packet: message sent from the leader to the followers.

"Calibrate local clock" the leader and follower are trying to generate the same beat pattern using their local clocks to determine the intervals between actions from the messages. The follower can compute how fast its clock ticks compared to the leader's and it computes all of its intervals accordingly. I.e., the leader implicitly defines what a second is and the followers compute the length of a second according to their local clock.

Beat pattern: the combination of rhythm and tempo.

Indicator: anything used to convey the beat to the human. This includes buzzers, clickers, flashers, vibrators and anything else that might be devised in the future.

Generally, the present invention provides a metronome capable of wireless communication with other similar metronomes. A metronome of the present invention also includes a tactile device capable of conveying the tempo and beat to a user without the use of sound.

A plurality of the metronomes of the present invention are capable of wireless communication with one or more similar metronomes. In one example, one of the metronomes is used as a lead unit (for example, controlled by a band leader or conductor) and transmits control signals to the other metronomes. This allows multiple musicians in an orchestra, or similar music ensemble, to each have a metronome that is synchronized with other metronomes and shares a common tempo and beat. In addition, by utilizing a tactile device, the musicians can have the use of a synchronized metronome without making undesired sounds.

FIG. 1 illustrates a view of one example of a metronome of the present invention. In the example of FIG. 1, a metronome 10 includes a housing 12 which houses the components of the metronome. The housing 12 may take any desired form, as needed. The example illustrated in FIG. 1 shows a housing 12 that could easily be placed in a shirt pocket, worn on a belt clip, etc. In another example, a housing 12 may be worn on a strap, such as on the user's arm or wrist, for example.

The metronome 10 includes a display 14 for displaying various information to a user (described in detail below). Of course, other visual indicators may also be used, such as lights. To control the operation of the metronome 10, a jog wheel 16 is used. Of course, various other types of user interfaces may also be used (for example buttons, touch screens, switches, dials, etc.). The jog wheel 16 can be rotated in either direction by a user to enable the user to scroll through menus displayed on the display 14. The jog wheel 16 can also be pressed inward to allow a user to select items displayed on the menu.

In addition to the display 14, the metronome 10 includes other user perceivable devices. A built-in speaker or buzzer 18 can be used to play sounds to a user. A tactile device 20 enables the metronome 10 to convey tactile information to a user. The tactile device 20 may take the form of a vibrator (similar to vibrators found in cell phones) or any other type of tactile device capable of conveying tactile information to the user. FIG. 1 also shows a battery compartment 22 (in this example formed in the back of the housing 12) for holding a battery to power the metronome 10.

Figure 2:
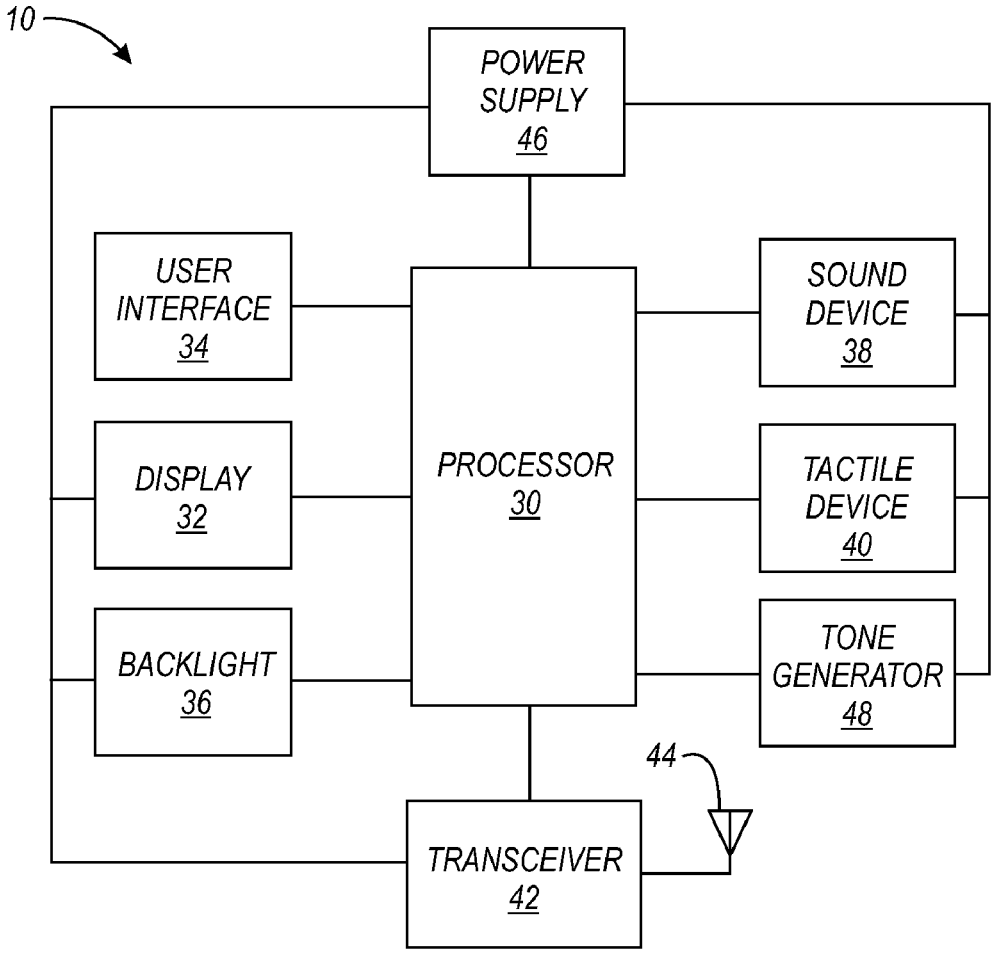
FIG. 2 is a block diagram of one example of a metronome of the present invention.

FIG. 2 is a block diagram of one example of the metronome 10. The metronome 10 shown in FIG. 2 includes a processor 30 for controlling the various functions of the metronome 10. The processor 30 is coupled to a display 32 (and/or to any other visual indicators) for displaying various information to user. User interface device(s) 34 (such as jog wheel 16 shown in FIG. 1, buttons, switches, etc.) is/are also coupled to the processor for allowing a user to control the operation of the metronome 10. A backlight 36 may also be used to illuminate the display 32, allowing a user to easily use the metronome in the dark, or under low light conditions.

The processor 30 is also coupled to a sound device 38, such as a speaker, buzzer, headset, or other audible device. A tactile device 40 is coupled to the processor 30 for providing tactile information to the user. A transceiver 42 and antenna 44 are coupled to the processor 30, enabling the metronome 10 to send and receive wireless signals to/from other devices. A tone generator 48 may be used to tune a user's instrument. A generated tone can be played via the sound device 38. If desired, a lead unit can instruct follower units to locally generate the tone (e.g., to enter a tuning mode). This may be useful in applications such as marching bands who may need to tune while being spread out across a field. FIG. 2 shows a power supply 46 which supplies power to the various blocks shown in FIG. 2. The power supply 46 is configured to supply regulated power for the logic and radio circuits as well as other voltage levels required by the various components of the metronome 10.

Figure 2A:
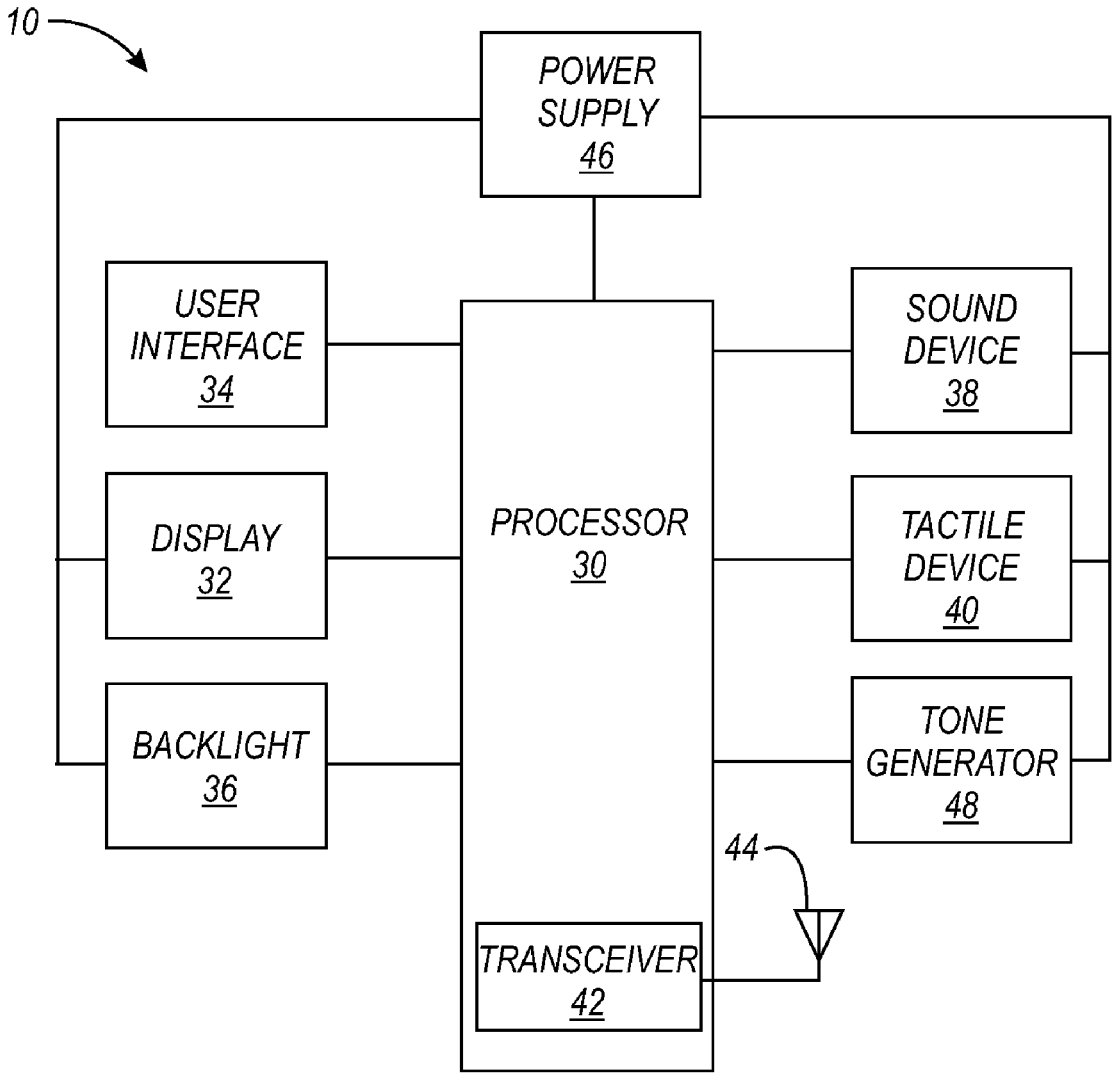
FIG. 2A is a block diagram of another example of a metronome of the present invention.

FIG. 2A is a block diagram of another example of the metronome 10. The metronome 10 shown in FIG. 2A is similar to the metronome shown in FIG. 2, but uses a processor chip having a radio transceiver formed on the integrated circuit. Other components, such as a display driver, may also be implemented on the same integrated circuit, if desired.

As mentioned above, the wireless capabilities of a metronome of the present invention allow the metronome to communicate wirelessly with one or more other similar metronomes. Typical applications may include (but are not limited to) orchestras and other musical ensembles, marching bands, etc. In addition, a metronome of the present invention may also be used as a stand-alone device for use by a musician while practicing, for example.

Figure 3:
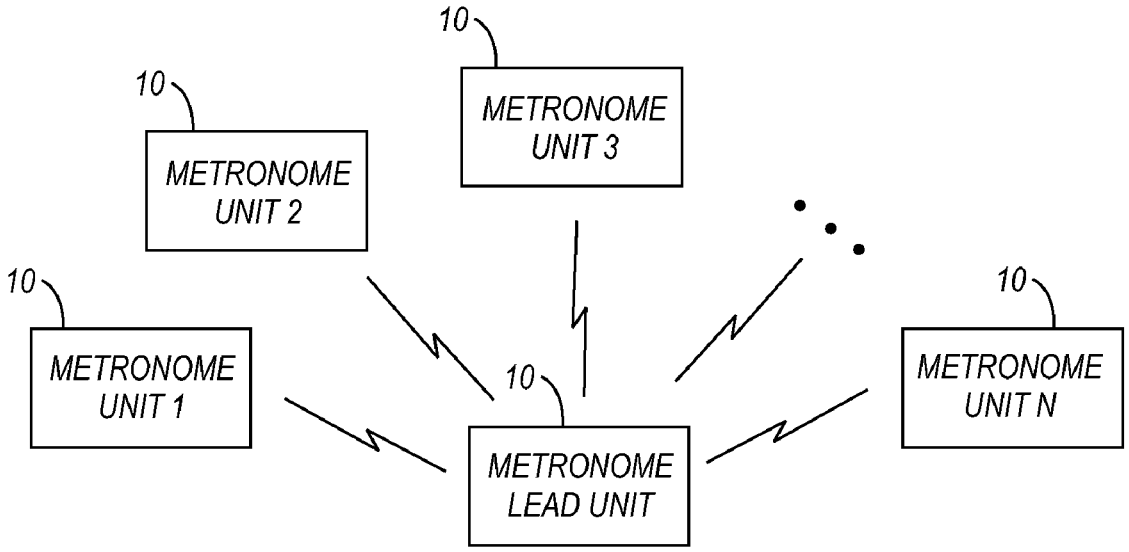
FIG. 3 is a block diagram of a plurality of metronomes of the present invention used by a plurality of musicians.

FIG. 3 is a block diagram of a plurality of metronomes 10 used together by a plurality of musicians. In this example, one of the metronomes 10 is configured (via a user-selected operating mode) as the "LEAD UNIT", and will dictate the beat and tempo to the other metronomes 10. In this example, N metronome units, plus the lead unit are shown. In one example, the lead unit is used by the conductor or band director to convey desired tempo and beat information to all of the musicians. The user of the lead unit can control the tempo and beat information of the lead unit metronome 10. The lead unit metronome 10 transmits signals to the other metronomes 10 to enable the N metronomes 10 to all be in synchronization with the lead unit metronome 10. Details of how the metronomes 10 communicate with each other are described below.

Figure 4:
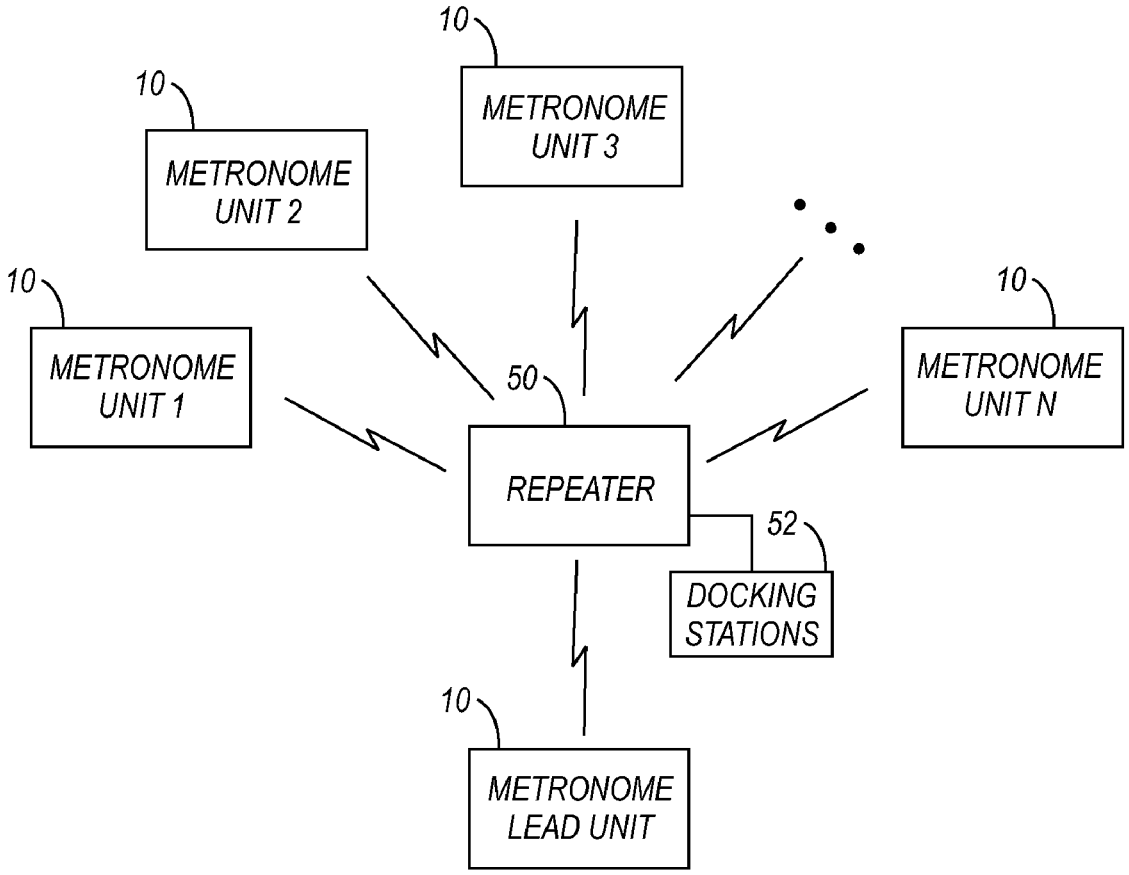
FIG. 4 is a block diagram similar to FIG. 3 illustrating another implementation of the present invention.

FIG. 4 is a block diagram similar to FIG. 3 illustrating another implementation of the present invention. In FIG. 4, a repeater 50 is used to transmit information to the metronomes 10. The lead unit metronome 10 still dictates the beat and tempo to the other metronomes 10, but does not transmit directly to all of the metronomes 10. The lead unit metronome transmits (either wirelessly or over a wired connection) signals to the repeater 50, which in turn transmits control signals to the N metronome units. One advantage of the configuration shown in FIG. 4 is that the repeater 50 can be configured to transmit at a higher power level than perhaps the lead unit metronome is capable. This reduces the power requirements of the lead unit, as well as increasing the wireless range of the system. The repeater 50 may take on any desired configuration. In one example, the repeater 50 is a powered unit, not dependent upon battery power. A repeater 50 may also include a plurality of docking stations 52 adapted to dock with a plurality of metronomes 10 between uses. The docking stations 52 can provide battery charging capabilities, as well as proving programmable memory of song data (tempos, beats, etc.) for playback.

Figure 5:
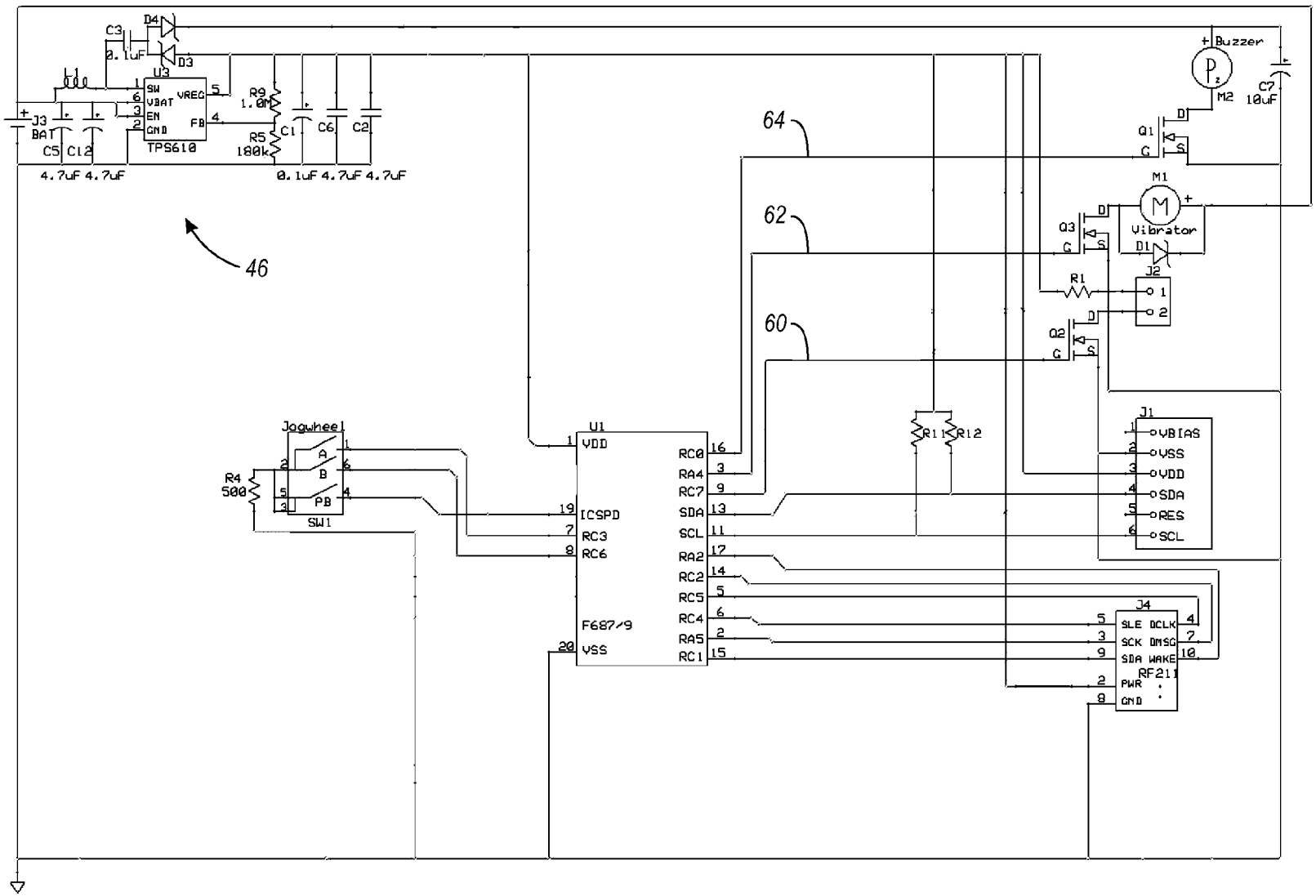
FIG. 5 is a schematic diagram of one example of a metronome of the present invention.

FIG. 5 is a schematic diagram of one example of a metronome of the present invention. Of course, a metronome of the present invention may be implemented in any desired manner. FIG. 5 shows a processor U1 for performing the functions described above with respect to FIG. 2. The processor U1 can be implemented using any desired processor that is capable of performing the operations desired. A jog wheel SW1 is coupled to the processor U1 for allowing a user to operate the metronome. The processor U1 decodes quadrature signals generated by the jog wheel, to determine how much and in which direction the jog wheel is rotated. Also, the processor receives a push button signal from the push button of the jog wheel. A power supply 46 is designed to provide various voltage and current requirements to the rest of the circuitry. In this example, the power supply 46 provides well-regulated power for the logic and radio circuits as well as less regulated power for the tactile outputs (such as a vibrator) and for a display backlight. The power supply 46 is powered by a battery (BAT).

The processor U1 is configured to drive a display which is connectable to an I2C interface J1. Of course, other interfaces could also be used to drive a display. If the display used includes a backlight (connectable to interface J2), the processor U1 controls the operation of the backlight via signal 60, which enables or disables transistor Q2 (in this example, an N-channel FET), which turns the backlight on or off. Resistor R1 has a value chosen to obtain a desired backlight current. Note that in other examples of the invention, a display is optional.

The processor U1 controls the operation of a vibrator M1 via control signal 62. The control signal 62 enables or disables transistor Q3 (in this example, an N-channel FET), which turns the vibrator on or off. The processor U1 controls the operation of a buzzer M2 via control signal 64. The control signal 64 and enables or disables transistor Q1 (in this example, an N-channel FET), which turns the buzzer on or off. The processor U1 also interfaces with transceiver J4. The transceiver J4 is part of a radio module (for example, including an antenna (not shown in FIG. 5), that provides the metronome with the capability of communicating wirelessly with other devices.

Figure 5A:
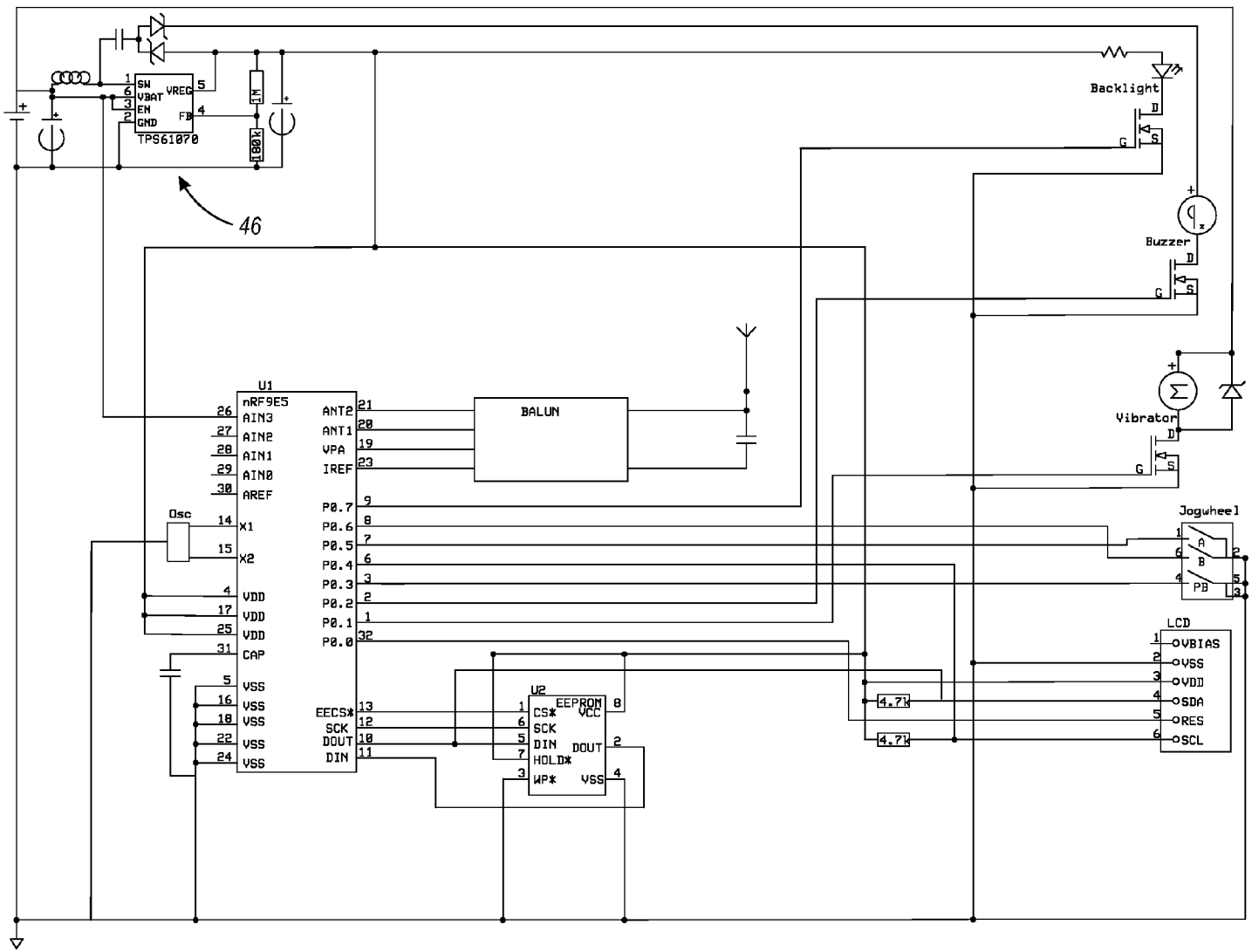
FIG. 5A is a schematic diagram of another example of a metronome of the present invention.

FIG. 5A is a schematic diagram of another example of a metronome of the present invention. One difference between FIG. 5 and FIG. 5A is that the processor U1 in FIG. 5A has an integrated radio transceiver. FIG. 5A also shows a balun (labeled "BALUN") coupled between the processor U1 and an antenna 44. Like with FIG. 5, the processor U1 for performs the functions described above with respect to FIG. 2 and FIG. 2A. A jog wheel (labeled "Jogwheel") is coupled to the processor U1 for allowing a user to operate the metronome. A power supply 46 is designed to provide various voltage and current requirements to the rest of the circuitry. The processor U1 is configured to drive a display, which in this example is an LCD display (labeled "LCD"). A backlight (labeled "Backlight") is also shown. The processor U1 controls the operation of a vibrator (labeled "Vibrator") and a buzzer (labeled "Buzzer"). FIG. 5A also shows an electrically erasable programmable read-only memory (EEPROM) U2, which is used as a non-volatile storage device for storing settings, programming information, etc.

Figure 6:
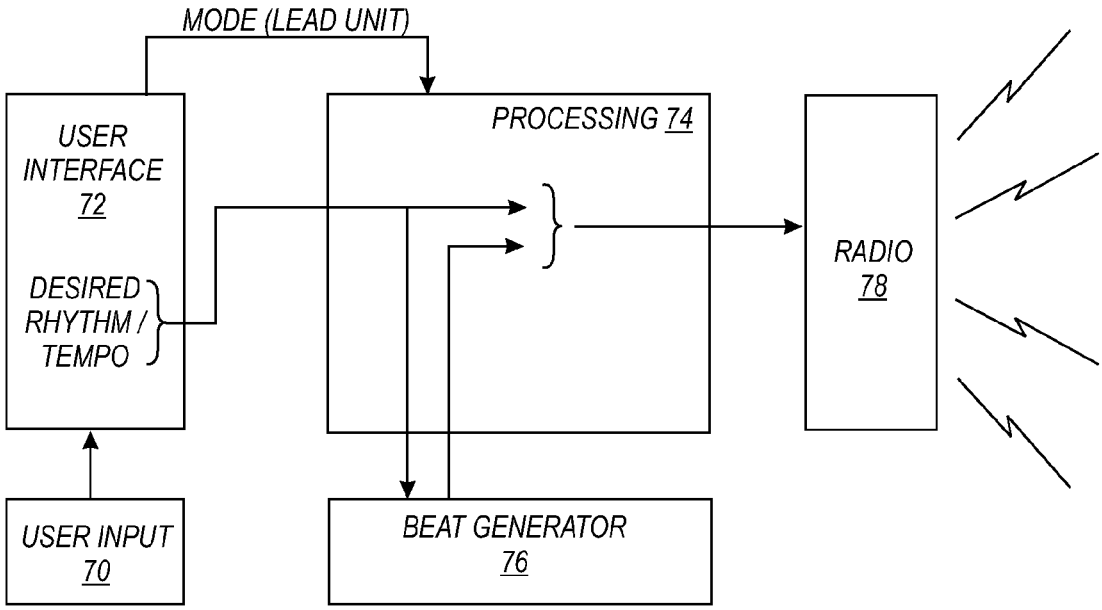
FIGS. 6-8 are functional block diagrams illustrating how a metronome of the present invention operations in various operational modes.
Figure 7:
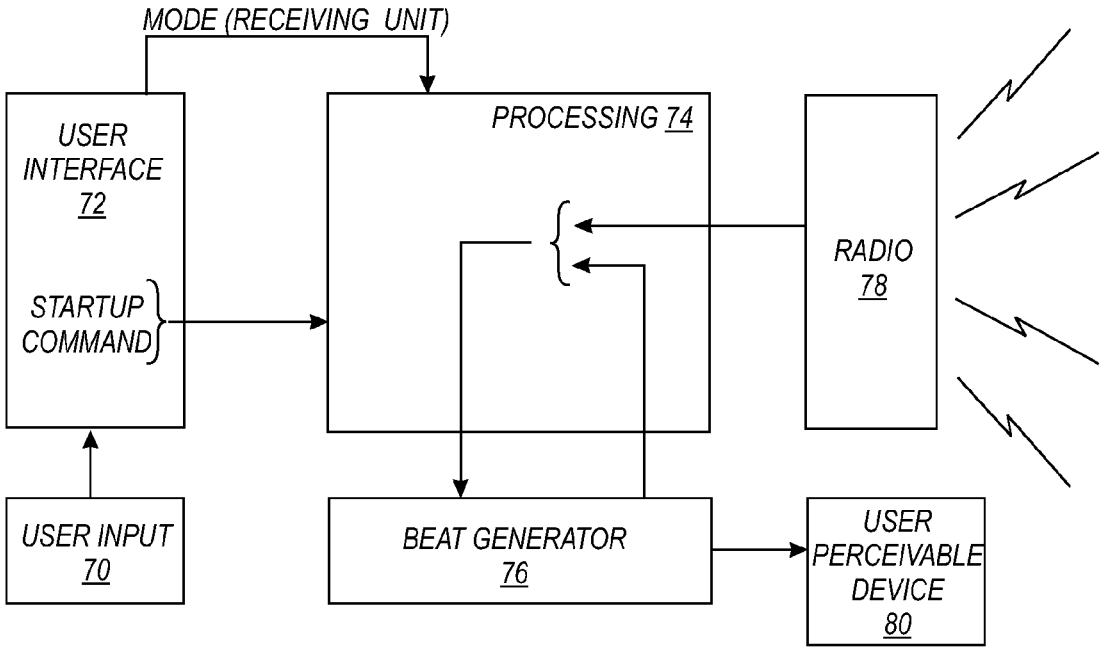
Figure 8:
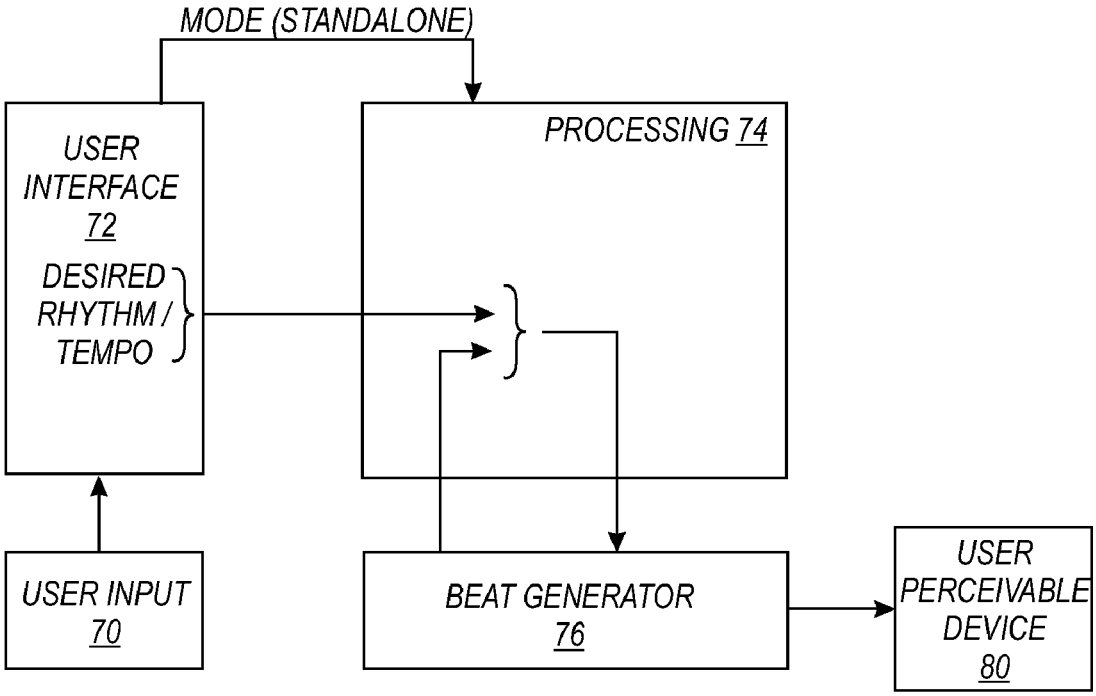

In one example, a metronome of the present invention is capable of operating in several modes. In a first mode, a metronome operates as a leader (the "lead unit"), such as the lead units shown in FIGS. 3 and 4. In this mode, the tempo and beat of a metronome can be set by a user, such as a conductor or band director. Using the wireless capabilities described above, one or more other metronomes can be synchronized to the lead unit. In a second mode, a metronome of the present invention (a "following unit" or "receiving unit") can receive instructions from a lead unit metronome. In a third mode, a metronome of the present invention can act as a stand-alone metronome, for example for use by a musician while practicing. FIGS. 6-8 are functional block diagrams illustrating the operation of a metronome of the present invention in the three modes described above. Of course, other modes of operation are also possible within the scope of the present invention.

FIG. 6 is a functional block diagram illustrating the operation of a metronome of the present invention in the "lead unit" mode. FIG. 6 shows a user input block 70 and user interface block 72, which a user uses to select the mode of operation. In this example, the lead unit mode has been selected. When a metronome of the present invention is in the lead unit mode, the user of that metronome selects a desired rhythm and/or tempo. The user interface 72 provides a processing block 74 with the selected mode, as well as the desired rhythm and/or tempo. The processing block 74 passes the desired rhythm and/or tempo to a beat generator 76 which generates the desired beat. The processing block 74 takes this information and provides instructions to a radio 78 which then wirelessly broadcasts a message to other metronomes. The broadcast message includes information relating to the desired rhythm and/or tempo.

During a musical performance, the user (e.g. conductor) of the lead unit metronome can change the rhythm, tempo etc. as desired, and the lead unit metronome 80 will broadcast the appropriate instructions for use by the other metronomes. In this way, all of the metronomes will be in synchronization, providing each musician with the desired rhythm and tempo.

FIG. 7 is a functional block diagram illustrating the operation of a metronome of the present invention in the "receiving unit" mode, such as the metronomes 1 through N shown in FIGS. 3 and 4. Like FIG. 6, FIG. 7 shows a user input block 70 and user interface block 72, which a user uses to select the mode of operation. In this example, the receiving unit mode has been selected. When a metronome of the present invention is in the receiving unit mode, the metronome waits to receive instructions from the lead unit metronome and conveys the appropriate information to the user. In this mode, the user interface 72 initiates a startup command in response to the metronome being turned on and/or placed in the receiving unit mode by a user.

When the radio 78 receives one or more messages from the lead unit metronome, the radio 78 passes that message to the processing block 74. The processing block 74, uses information from the received message to generate a control signal for the beat generator 76. In response, the beat generator generates the appropriate signals to drive one or more user perceivable devices 80. As mentioned above, the user perceivable devices 80 may include one or more of the following: sound, a tactile device, visual indicator, etc. As the conductor, or other user of the lead unit metronome makes changes to the rhythm and/or tempo, the receiving unit metronomes will make the appropriate changes as dictated by the lead unit metronome. In this way, all of the receiving unit metronomes will be in synchronization with each other, and will maintain the rhythm and/or tempo dictated by the lead unit metronome. The figures show the beat generator 76 signaling the processing block 74. This signaling is done so that the processing block 74 may manage overall power consumption of the system, most especially so that it might turn off the radio 78 when the user perceivable device(s) (e.g., the tactile outputs) are on to lower the maximum current required of the power supply.

FIG. 8 is a functional block diagram illustrating the operation of a metronome of the present invention in a "stand-alone unit" mode. This is a mode that a user may select while practicing music alone, rather then when practicing with a group. As a result, a user of a metronome of the present invention can not only use the metronome in new ways described above, but also as a conventional metronome.

Like FIGS. 6 and 7, FIG. 8 shows a user input block 70 and user interface block 72, which a user uses to select the mode of operation. In this example, the stand-alone unit mode has been selected. When a metronome of the present invention is in the stand-alone mode, the metronome waits for instructions from the user. After a user has entered a desired rhythm and/or tempo, the user interface 72 provides this information to the processing block 74. The processing block 74 uses this information to generate the appropriate control signal for the beat generator 76. In response, the beat generator 76 generates the appropriate signals to drive one or more user perceivable devices 80.

When implementing the present invention, various protocols can be used in conjunction with the communication between a lead unit and a following unit. Examples of different protocols can vary in the details of what is explicitly sent in a packet, and what is derived from the timing of the packets themselves, and in how often the packets are sent. One tradeoff between various protocols is power consumption (e.g., increased by the amount of explicit content and frequency of sending) versus the time it takes for a system to change the beat pattern. A secondary consideration is the effects of noise on the messages. Adding error correction bits to each message increases power consumption. Also, an error not recognized can cause a follower to lose track of the leader which in turn causes it to burn power trying to find the leader again. In one exemplary implementation, the following units continue to generate the last beat pattern they were programmed with while trying to find the lead unit. This is significantly different than a system whereby the followers receive nothing beyond on/off signals for the indicator.

Figure 9:
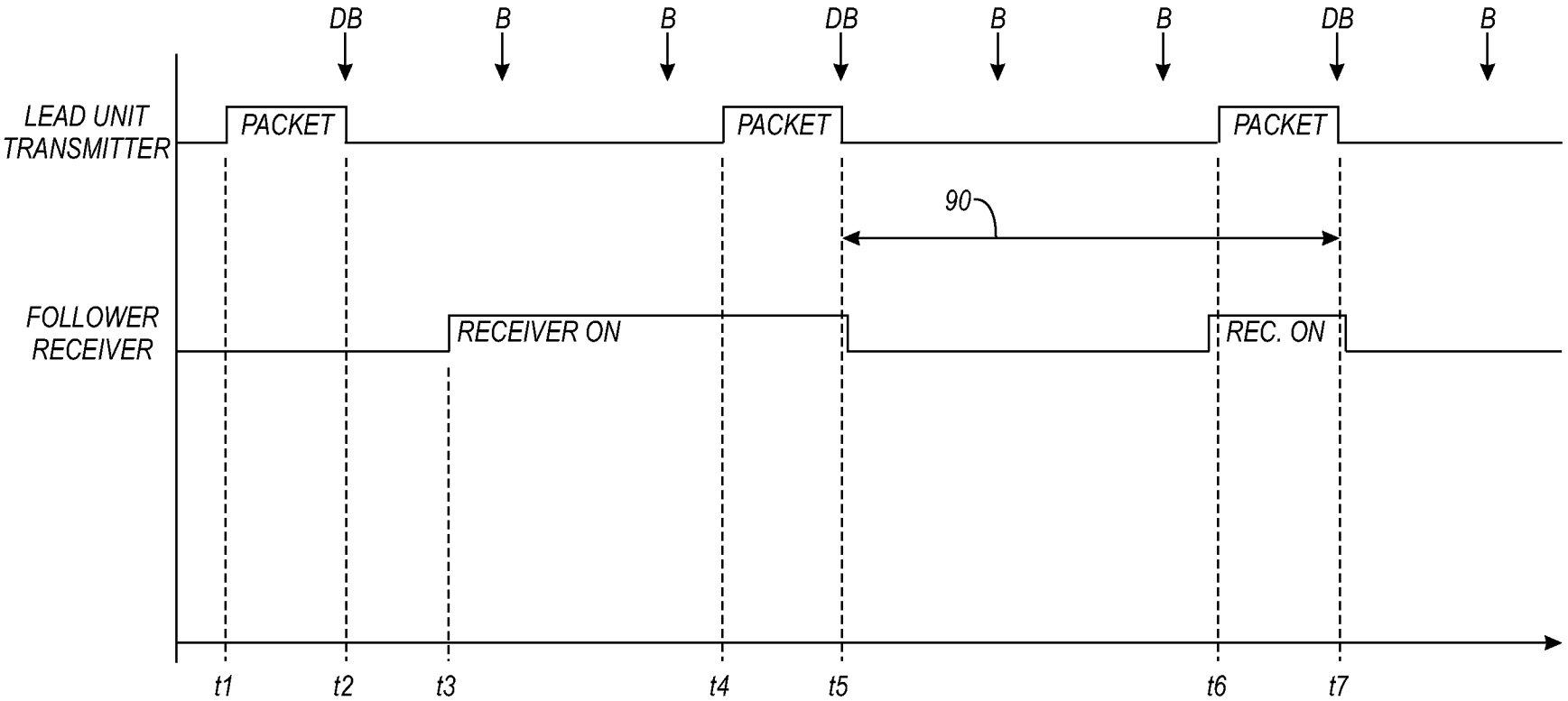
FIGS. 9-11 are timing diagrams illustrating examples of protocols that may be used with the present invention.
Figure 10:
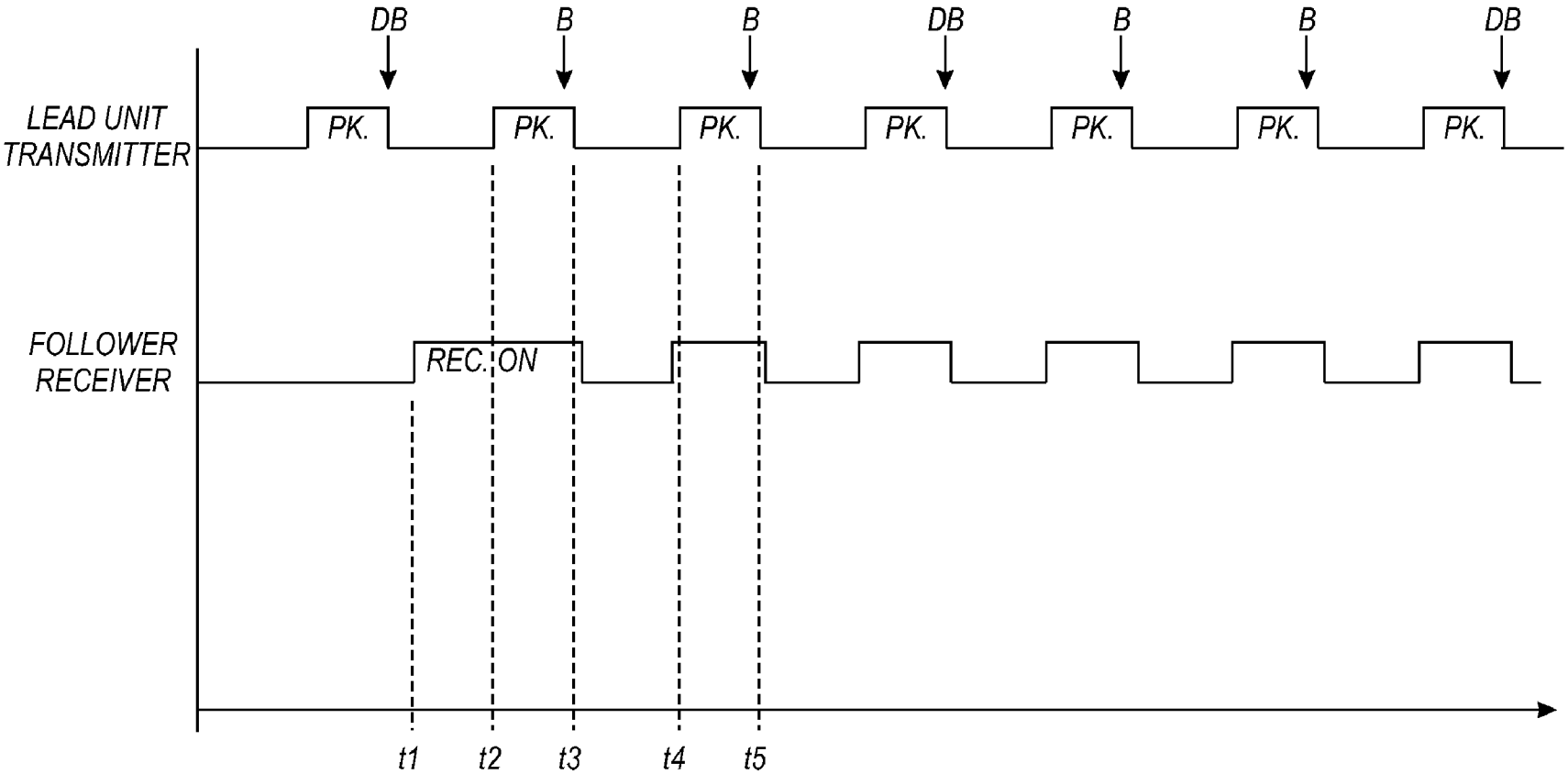
Figure 11:
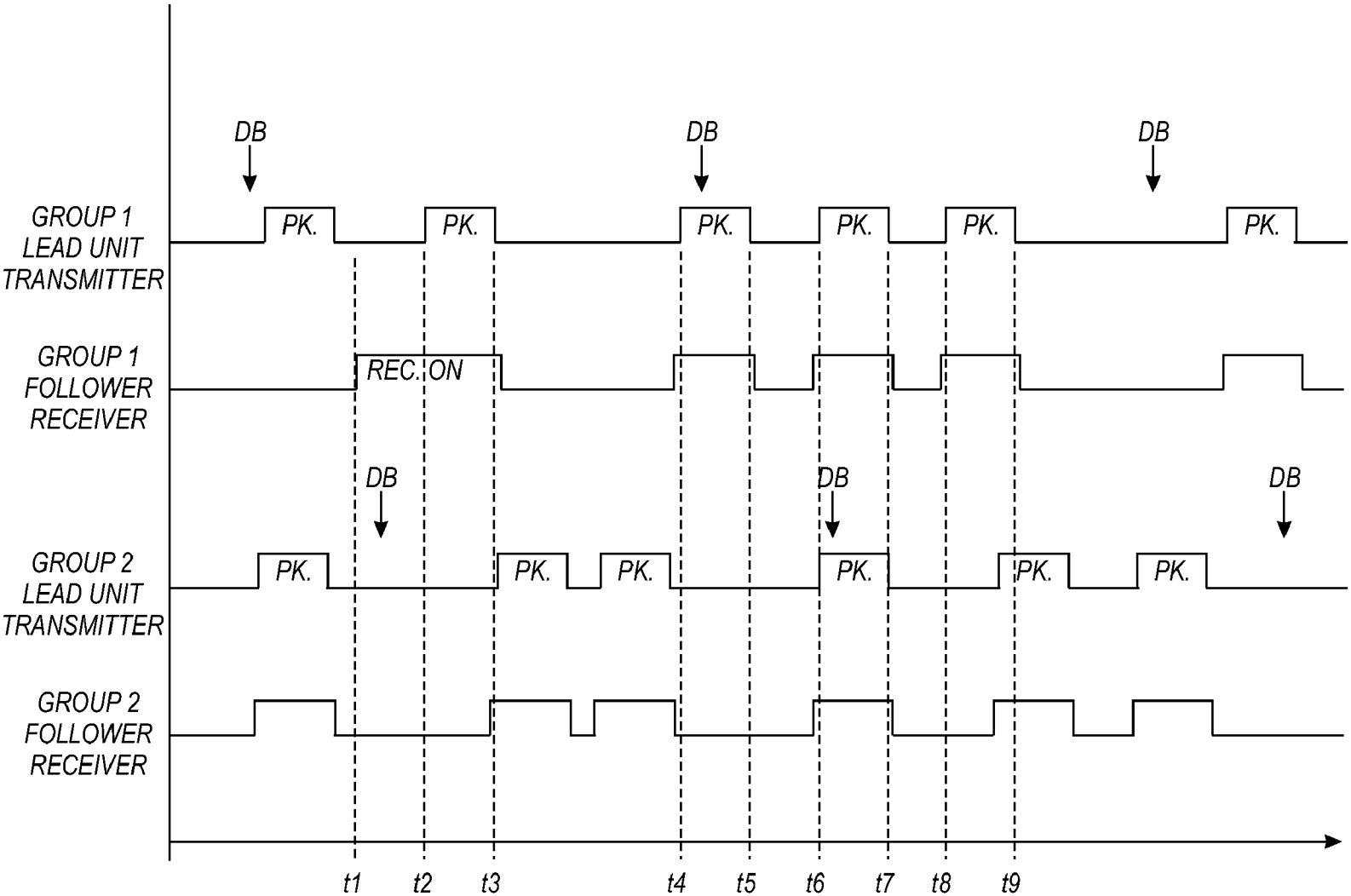

FIGS. 9-11 are timing diagrams illustrating examples of protocols that may be used with the present invention. Note that various other examples and variations of protocols may also be used with the present invention. FIG. 9 is a timing diagram illustrating when a receiving unit either is turned on, or is re-synchronized with a lead unit. FIG. 9 illustrates the transmission of packets beginning at times t1, t4, t6, and ending at times t2, t5, t7. A follower unit receiver is shown being turned on at time t3. FIG. 9 is described in more detail below.

Following is a technique for synchronizing local clocks (clocks in follower units) with the lead unit clock. In one implementation, the follower unit has a counter counting a local clock (local here simply means one not typically derived from the radio reception). The leader sends out packets of known size at a known time. As each packet is received by a follower unit, the time since the last packet is noted and used to compute the number of local clocks per the leader's clock. In this way, the beats are kept at a common rate, despite variations amongst the followers' clock rates. As mentioned above, in FIG. 9, packets are shown being sent at times t1, t4, and t6, each having a known size, and being sent at a known time. Once a follower unit is synchronized with the lead unit, the local clock of the follower unit can be calibrated with the clock of the lead unit. The following unit can determine the time since the last packet (e.g., the difference between times t7 and t5, illustrated by line 90. The follower unit can then compute the number of local clocks compared to the lead unit's clock to keep beats at a common rate, despite variations amongst the followers' clock rates.

When a follower joins a group (by turning on or changing channel) the follower turns its receiver on until it receives a packet from the leader. In the example of FIG. 9, the follower receiver is turned on at time t3 and is able to receive the next packet, starting at time t4. Once a packet is received by the follower unit, the follower unit can stay synchronized with the lead unit, based on information contained in the packet. In some exemplary protocols, the follower unit may have to receive two packets before it can operate at full performance. Once synchronized with the protocol the receiver of the follower is only turned on when a message is expected. In the example of FIG. 9, the follower unit receiver is turned off between packets (e.g., between times t5 and t6). Note that, in this example, the receiver is turned off shortly after time t5, and turned on shortly before time t6, to ensure that the entire packet is received. One advantage of this feature is that a follower unit will consume less power than if its receiver were turned on at all times. If the follower unit misses some number of packets in a row, then it turns the radio on continuously until it gets a packet (similar to that shown between times t3 and t4 in FIG. 9). The presumption is that a corrupted packet was acted upon and the follower's timing is so far off that it is missing the leader's packet. In one example, if no packet is received for some duration (e.g., about 15 seconds, in one example), then the follower shuts off its radio, and the user can wake it back up again via the user interface to get it to look for a leader.

In addition to information used for beat pattern generation, the protocol can send other information in messages (via the packets) to the follower units. For example, other information can include instructions to change radio channel, power down, synchronization signals, etc. Such messages can be sent out many times in a row when they are triggered by the leader to give all followers a chance to miss a few packets and still respond (i.e., noise immunity). The packet format allows for the sending of information unrelated to beat generation, which can be used to control whatever features of the follower units that the product allows. Other examples include the leader unit telling all of the followers to quit making noise (e.g., a silent mode). In one example, the packet interval is set to about 4 seconds. The leader unit can also tell all of the followers to shut down totally. After a shut down, each unit may need to be woken back up by the user interface before it will follow the leader again.

In one protocol example, a packet sent by the leader is timed to end at the end of each downbeat. In FIG. 9, this is illustrated by the arrows labeled "DB." The leader sends the packet with information including its present rhythm and tempo settings. After synchronization, the follower units can use the time between the ends of successive packets (e.g., the time between times t7 and t5, etc., as described above) to adjust their local clock computations to best match the periods that the leader is generating.

When a follower starts up, it turns its receiver on (e.g., time t3 in FIG. 9) until the first packet is received (e.g., time t4 in FIG. 9). After a packet has been received by the follower, the follower only turns on its receiver in advance of the next expected packet. This increases the energy efficiency of the metronome follower unit, since the radio can be turned off most of the time.

To reduce peak power requirements the phasing of packets with respect to signaling is adjusted so that the radio is only turned on when the signaling devices should be off. In one example, the time in advance of the next packet, in which the receiver is turned on again, can be computed as follows.

a) radio must be on for:

time for the receiver to be ready to receive after powered up+maximumLengthPacket*timePerBit* maximumRatioLeaderClockPeriodToFollowerClockPeriod b) the power consuming signaling devices are off for:

clocksperBeat—clocks that the signalers are on c) therefore: the radio is turned on b-a clocks before the next beat is due.

The value maximumRatioLeaderClockPeriodToFollowerClockPeriod can generally be computed for a design and not measured by the actual units. For instance, if a microcontroller's internal clock is factory calibrated to be within 1% of nominal this factor will be 101/99.

Should the number in c) be negative, the radio must be turned on before the signalers are turned off. That is undesirable and one would instead reduce the size of the packets until c) is positive by splitting the content into two or more types of packet adding to each packet an indication of which type it is. E.g. send the rhythm in the first of three, the tempo in the second, administrative items (hush) in the third. Another variation of that is to send shorter packets with the most important (tempo) sent more often and items like hush (turn all signalers off) being sent only for a handful of packets when it changes on the leader.

In another protocol example, to shorten the length of the packets, and thereby reduce the amount of time both transmitter and receivers are on for each packet, the information contained in the packets alternates between {rhythm and tempo and timeToNextPacket} and {timeToNextDownbeat and timeToNextPacket}. That is, while each packet contains the time to next packet, they alternate between the pair of rhythm and tempo values and the timeToNextDownbeat.

Packets may also be sent less frequently for the purpose of increasing battery life of the lead and follower units, independent of other considerations. In one example, follower units can choose to skip checking on various downbeats in order to save power when they detect that they are almost out of power. The cost of this is that the unit will be slower to respond to changes of beat pattern. In one example, the frequency of packets being sent by the lead unit can be varied, depending on the tempo. For example, when downbeats are more frequent, packets can be sent at a less frequent rate. In that way power is reduced while packets still arrive often enough to keep the clocks synchronized.

In another protocol example, the packet is timed to end at the end of each beat. In this example, the leader sends a packet every beat. Information in the packet may include current rhythm and tempo settings, whether the next beat is the downbeat, or alternatively which beat of the measure it is. All else can be similar to the first protocol described. FIG. 10 is a timing diagram of this exemplary protocol. As shown, a packet sent by the lead unit is timed to end at the end of each beat. In FIG. 10, the beats (other than the downbeat) are illustrated by the arrows labeled "B." In this example, an unsynchronized follower unit turns on its receiver at time t1 until a packet is received. Between times t2 and t3, a packet is received. Since the packet includes information relating to the current rhythm and tempo settings, whether the next beat is the downbeat, etc., the following unit is able to synchronize with the lead unit. Thereafter, the follower receiver is turned on at times corresponding to when packets are sent. Like before, in this example, the receiver is turned on shortly before the packet is expected, and turned off shortly after the packet has ended.

In another protocol example, the protocol is directed at dealing with interference from another assemblage of users of this same product. Even though nearby groups can select different channels to operate on there is still a greater rate of communications errors when more than one leader is transmitting at the same time.

In this example, the packets are not sent synchronized to the tempo as was done for the protocols described above. Packets may include information relating to rhythm, tempo, timeToNextDownbeat, and timeToNextPacket. The timeToNextPacket comes at the end of the packet so that receivers that turn on during the middle of a packet know when to listen for the next packet. The timeToNextPacket tells the follower units when the next packet is coming. The timeToNextPacket may be randomly (or pseudorandomly, etc.) varied such that multiple leaders are unlikely to send successive packets at the same time. In one example, the average period of the synchronization packets is around one second, this value is chosen primarily by consideration of how long it should take for a new unit to come online. In one example the packet includes information unique to its lead unit, which enables a follower unit to disregard packets received from other lead units. If desired, a packet can also provide the time to additional future packets, in addition to the next packet.

FIG. 11 is a timing diagram illustrating this exemplary protocol. In FIG. 11, transmitted packets are shown from two separate groups (Group 1 and Group 2). Referring to Group 1, as shown, packets are sent by the lead unit, but are not timed with the downbeats. In FIG. 11, exemplary downbeats are shown to illustrate that the packets are not timed with the downbeats. In this example, an unsynchronized Group 1 follower unit turns on its receiver at time t1 until a packet is received. Between times t2 and t3, a packet is received. The packet includes information relating to the current rhythm and tempo settings, etc. In addition, the packet includes information relating to the time to the next downbeat. As a result, the Group 1 follower unit will know that the next packet is supposed to be transmitted at time t4 by the Group 1 lead unit. The Group 1 follower unit therefore will turn on its receiver in time to receive the packet that comes between times t4 and t5. Similarly, the packet received between times t4 and t5 will tell the Group 1 follower unit when the next pack will be transmitted by the Group 1 lead unit, and so forth. In other examples, each packet can tell the follower unit when the next two or three, etc. packets are coming. If desired, this information can be used to help ensure synchronization in the event that a packet is missed, or can be used to conserve battery power by skipping the reception of some packets.

FIG. 11 also shows packets transmitted by the Group 2 lead unit. In this example, the Group 2 follower unit is already synchronized, and turns its receiver on during times that it expects a packet from the Group 2 lead unit. Referring again to Group 1, when the Group 1 follower unit receives a first packet, (between times t2 and t3), the Group 2 lead unit is not transmitting. In this example, during the next two packets transmitted by the Group 2 lead unit, the receiver of the Group 1 follower unit is turned off. When the Group 1 follower unit receives a second first packet, (between times t4 and t5), the Group 2 lead unit is not transmitting. However, during the next packet (between times t6 and t7), the Group 2 lead unit also transmits a packet. If this causes interference, or results in a corrupted packet received, the Group 1 follower unit can disregard the packet, and wait for the next expected packet. During the next packet (between times t8 and t9), the Group 2 lead unit begins transmitting a packet during a portion of the Group 1 packet. If this causes interference, or results in a corrupted packet received, the Group 1 follower unit can disregard the packet, and wait for the next expected packet.

In another example, packets can contain information relating to future events. For example, if the tempo or rhythm is going to change at some point in the future, a packet may contain information relating to the future change. For example a packet may tell a follower unit that the rhythm is changing to X in Y seconds (or, at a specific time in the future). The follower unit can initiate a countdown procedure so it will know when change the rhythm.

Following are comparisons of the protocol examples described above. The first (FIG. 9) and second (FIG. 10) examples (FIG. 9 and FIG. 10) are minor variations of beat-synchronized sending while the third and fourth examples (FIG. 11) are minor variations of random sending. The beat-synchronized sending protocols have shorter packets, hence lower power per packet. The random sending protocols have longer packets, but can compensate for this by not sending packets as often. The synched sending protocols may be easier to implement, but the random sending protocols have more flexibility for power control.

Following is an example of how a metronome of the present invention can operate. Using the jog wheel (or whatever user interface device that is provided), a user is able to select various options and features. For example, a user can select a group number, which determines what frequency channel the metronome will use. This way, different groups, using the same types of metronomes, can operate without interfering with each other. A user can also select operating modes that affect signal, battery life, etc. For example, different settings may have tradeoffs between battery life versus time-to-respond settings. A user can also select notification options such as sound, vibration, flashing of a light, or combinations thereof. A user can also select the mode of operation, such as group, solo, or conductor. If desired, a password can be required for entering certain modes, to prevent an unauthorized user from interfering with the conductor, for example. A user can also select various power-off options, such as powering off now, powering off in a certain number of minutes, or powering off after the loss of beat (or synchronization).

When a user has selected to operate in the solo mode (e.g., see FIG. 8), the user can be prompted to select the mode (described above), group/channel (described above), a rhythm setting, notification options (described above), and power options (described above). When a user has selected to operate in the conductor mode (e.g., see FIG. 6), the user can be prompted to select the mode (described above), group/channel (described above), a rhythm setting, a service setting (e.g., setting up a password, etc.), and power options. In the conductor mode, the power options may include shutting down the lead unit only, shutting down the follower units, shutting down the follower units then the lead unit, etc. Of course, various other options and modes of operation are possible.

Other design considerations are as follows. Measures typically run from ½ second to 2 seconds in duration. In one example, the shortest beat supported could be greater than 240 ms in duration. To make changes happen quickly, the maximum interval between messages may be on the order of two seconds. Sending packets once per measure (example protocol one—FIG. 9) is thereby adequate with respect to change of setting. Only for short measures would random sending be able to be done at a frequency lower than the measure. This means that instead of implementing the random method we would simply start skipping every other packet of the synchronous protocols if power becomes a consideration.

Other design implementation considerations follow. The beat generator may be driven by a clock typically around 33 kHz (since many processors are optimized for that). On each clock, a unit figures out where in the beat cycle it is and from that information it can turn on or off the various signaling components (buzzers and clickers and the like) and especially turns the radio on at the appropriate time. The user interface pins (two quadrature inputs and push button input—shown in FIG. 5 as pins 7, 8, 19 of processor U1) are also sampled every so often using this clock. Each input-changed event potentially results in the display being updated or some other action being taken.

A very long counter is created via updating a series of bytes of general storage on the overflows of the hardware counter that counts the reference clock cycles. It may be desired to define "Maximum deadtime" as the maximum number of packets in a row that can be skipped without triggering the "just powered on" behavior. The range of this counter is such that it can count clocks without rollover for the maximum deadtime. The resolution of this counter (how often it is incremented) is high enough that an error of one count when multiplied by the number of beats that can occur during the maximum deadtime is less than what will annoy a human. In one example, this can be set to 2.5 ms, although any desired value can be used. Increasing the tolerance for drift under pessimistic noise conditions allows the resolution of this counter to be reduced, which in turn allows the main clock frequency of the microcontroller to be lowered, which in turn reduces its power consumption, which however is quite low to start with when compared to the radio.

This frequency will also be reduced when multiple samplings of the reference period are recorded from the leader and the number of local clocks per beat is cycled through this set of values such that the average of these values matches the average of the received values. Some people refer to this as dithering. The use described here is isomorphic to modifying the period of a PWM circuit on each rollover of its period. While the actual numbers will be in the thousands following is an example with smaller values.

Say that the leader is generating packets every 10 clocks. The receiver is running a bit slower and it measures half of the periods as 9 and half as 10. It then alternates between using 9 clocks between beats and 10 clocks per beats in its beat generation. Note that if the measured period is not toggling between two adjacent values then the system isn't stable enough to reliably operate. The benefit to resolution of increasing the number of such values decreases logarithmically, while the cost of time-to-respond-to-actual-changes increases linearly.

Another technique for increasing the resolution is to use a weighted sum of the most recent measurement and the sum of previous ones (single element IIR filter). The clocks per beat=most recent delay between packets*factor+(1-factor)*clocks per beat. This has the benefit of taking less ram storage, at the cost of code to compute the weighted average and a time-to-respond-to-actual-change that can take many more beat cycles to settle in to a new value than the dithering technique for a similar amount of averaging of the value.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. A method of providing tempo information to one or more musicians using a lead device and musician metronomes comprising:

providing a musician with a metronome, the metronome having a receiver for receiving wireless signals from a lead device relating to programming a desired tempo during an advancing time period, and having a tactile device for conveying a tactile message to a user of the metronome;

enabling the receiver when a signal is expected from the lead device for programming the tempo for the advancing time period disabling the receiver during times when a signal is not expected from the lead device; and providing tactile messages to the user of the metronome, wherein the tactile messages convey the desired tempo to the user, and wherein tactile messages are provided to the user of the metronome as previously programmed while the receiver is disabled.

2. The method of claim 1, wherein signals received by the receiver include information relating to when one or more future signals will be sent.

3. The method of claim 1, wherein signals received by the receiver include instructions for the metronome to enter one or more operating modes.

4. The method of claim 3, wherein signals received by the receiver include instructions for the metronome to enter a silent mode.

5. The method of claim 3, wherein signals received by the receiver include instructions for the metronome to shut down.

6. The method of claim 3, wherein signals received by the receiver include instructions for the metronome to enter a tuning mode for tuning a musical instrument.

7. The method of claim 1, wherein signals transmitted by the lead device are synchronized with the downbeat.

8. The method of claim 1, further comprising controlling the metronome using a jog wheel formed on each respective metronome.

9. The method of claim 1, further comprising relaying signals from the lead device to the metronome using a repeater.

10. The method of claim 1, wherein the metronome includes a beat generator for maintaining the operation of the tactile device when signals are not received from the lead device.

11. A method of providing tempo information to one or more musicians using a lead device and musician metronomes comprising:

providing a musician with a metronome, the metronome having a receiver for receiving wireless signals from a lead device that provide programming to the metronome and having a tactile device for conveying a tactile message to a user of the metronome;

synchronizing the metronome with the lead device;

during a first time period, enabling the receiver and receiving a signal from the lead device, the signal having information relating to programming a desired tempo during an advancing time period providing tactile messages to the user of the metronome, wherein the tactile messages convey the desired tempo to the user; and during a second time period, continuing to provide the tactile messages to the user programmed in the first period while disabling the receiver.

12. The method of claim 11, wherein signals received by the receiver include information relating to when one or more future signals will be sent.

13. The method of claim 11, wherein signals received by the receiver include instructions for the metronome to enter one or more operating modes.

14. The method of claim 11, further comprising controlling the metronome using a jog wheel formed on the metronome.

15. The method of claim 11, further comprising continuing to provide the tactile messages to the user during time periods that the metronome becomes unsynchronized with the lead device.

16. A metronome comprising:

a transceiver for transmitting and receiving wireless signals encoded with messages regarding a tempo programming for the metronome;

a tactile device and configured to provide a tactile sensation to a user of the metronome;

a beat generator; and a processor electrically coupled to the transceiver, the tactile device, and the beat generator, wherein the processor and beat generator cause the tactile device to convey tempo information to a user in response to a desired tempo indicated by one or more messages received by the transceiver, and wherein the beat generator maintains the desired pre-programmed operation of the tactile device during times that the transceiver is not receiving messages.

17. The metronome of claim 16, further comprising a jog wheel operatively coupled to the processor for providing a user interface to the metronome.

18. The metronome of claim 17, wherein the jog wheel allows a user to turn the wheel in either direction and press an integrated push button to control the operation of the metronome.

19. The metronome of claim 18, wherein the metronome includes a quadrature encoder/decoder to detect movement and direction of movement of the jog wheel.

20. The metronome of claim 16, further comprising a tone generator for providing a tone to a user.

21. The metronome of claim 20, wherein the tone generator is controllable by messages received by the transceiver.

22. The metronome of claim 16, wherein the transceiver is configured to be turned on when a message is expected and turned off when no message is expected.

* * * * *